United States Patent [19]

Takemori

[11] 4,287,992

[45] Sep. 8, 1981

[54] RACK STRUCTURE

[75] Inventor: Kanji Takemori, Toyonaka, Japan

[73] Assignee: Shimoda Kogyo, Ltd., Osaka, Japan

[21] Appl. No.: 13,225

[22] Filed: Feb. 21, 1979

[30] Foreign Application Priority Data

| | | | |
|---|---|---|---|
| Jul. 11, 1978 | [JP] | Japan | 53/84694 |
| Aug. 23, 1978 | [JP] | Japan | 53/103174 |
| Aug. 23, 1978 | [JP] | Japan | 53/116061[U] |

[51] Int. Cl.[3] ..... A47F 1/00

[52] U.S. Cl. ..... 211/49 D; 312/45

[58] Field of Search ..... 211/49 D; 312/42, 45; 221/281

[56] References Cited

U.S. PATENT DOCUMENTS

| | | | |
|---|---|---|---|
| 2,888,145 | 5/1959 | Knott et al. | 211/49 D |
| 2,901,118 | 8/1959 | Beesley | 211/49 D |
| 3,298,763 | 1/1967 | DiDomenico | 211/49 X |
| 3,348,733 | 10/1967 | Johnson | 221/298 |
| 3,533,536 | 10/1970 | Baxendale | 221/281 |

FOREIGN PATENT DOCUMENTS

| | | | |
|---|---|---|---|
| 988136 | 4/1965 | United Kingdom | 211/49 D |

*Primary Examiner*—Roy D. Frazier
*Assistant Examiner*—Robert W. Gibson, Jr.
*Attorney, Agent, or Firm*—Stevens, Davis, Miller & Mosher

[57] ABSTRACT

The present invention is directed to a rack structure for use in vending machines of the serpentine stack type which comprises a pair of rack halves each formed in a single unitary body, said rack halves when combined together in face to face relation having at least one serpentine passage for accommodating a plurality of articles. At least one of pair of rack halves comprises a side wall and a plurality of rows of ramp assemblies projected from said side wall, each ramp assembly having ramp members protruding into respective spaces each defined between the adjacent two ramp members of the other ramp assembly so as to define the serpentine passage.

9 Claims, 13 Drawing Figures

RACK STRUCTURE

BACKGROUND OF THE INVENTION

1. Field of the Invention

The present invention relates to a rack structure for use in vending machines of serpentine stack type, more particularly to a rack structure comprising a pair of rack halves each having a plurality of ramp members and a side wall formed in a single unitary body.

2. Description of the Prior Art

In conventional vending machines for use in canned or bottled beverages, it is well known to provide a rack structure having a plurality of ramp members so that the cans or bottles are accommodated in serpentine passages defined by the ramp members as disclosed in U.S. Pat. Nos. 3,348,733 and 3,379,294.

The ramp members employed in the conventional rack structure heretofore are constituted by a number of elongated J shaped sheet metal components which must be independently mounted between upright walls of the housing of a vending machine one by one by means of securing members such as screws. Therefore, work for installing the ramp members into the vending machines becomes much complicated.

In addition, such ramp members must be mounted on the walls precisely at predetermined position so that the cans accommodated in the serpentine stack can gravitate along the ramp members without being jammed. Thus, the conventional vending machines require a lot of time when they are fabricated and therefore the vending machines become expensive.

Furthermore, since the conventional ramp members are made of generally flat plates, they can not be used in vending machines for selling bottled articles.

SUMMARY OF THE INVENTION

The present invention is made to eliminate such drawbacks inherent in the conventional rack structure as mentioned above.

An essential object of the present invention is to provide a rack structure which can be readily installed in vending machines, thereby resulting in reduction of time and cost of manufacturing the vending machines.

Another object of the present invention is to provide a rack structure having one or more serpentine passages defined by continuous ramp surface for facilitating the articles accommodated therein to gravitate without being jammed.

According to one aspect of the present invention, there is provided a rack structure for use in a vending machine which comprises a pair of rack halves each formed in a single unitary body, said rack halves when combined together in face-to-face relation having at least one serpentine passage defined therein, said serpentine passage having one end, through which a plurality of articles are supplied successively into the serpentine passage, and the other end from which the articles in the serpentine passage can be removed one at a time out of the rack structure, and means for connecting the rack halves together, said one end of the serpentine passage being positioned above said other end of the serpentine passage such that the articles accommodated within the serpentine passage can move downwardly from said one end towards said other end successively by the gravitational force each time the articles are removed out of the rack structure from said other end one after another.

Further scope of applicability of the present invention will become apparent from the detailed description given hereinafter. However, it should be understood, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Preferred embodiments of the present invention will be illustrated hereinafter in reference to the attached drawings, in which.

DETAILED DESCRIPTION OF THE INVENTION

Figure 1:
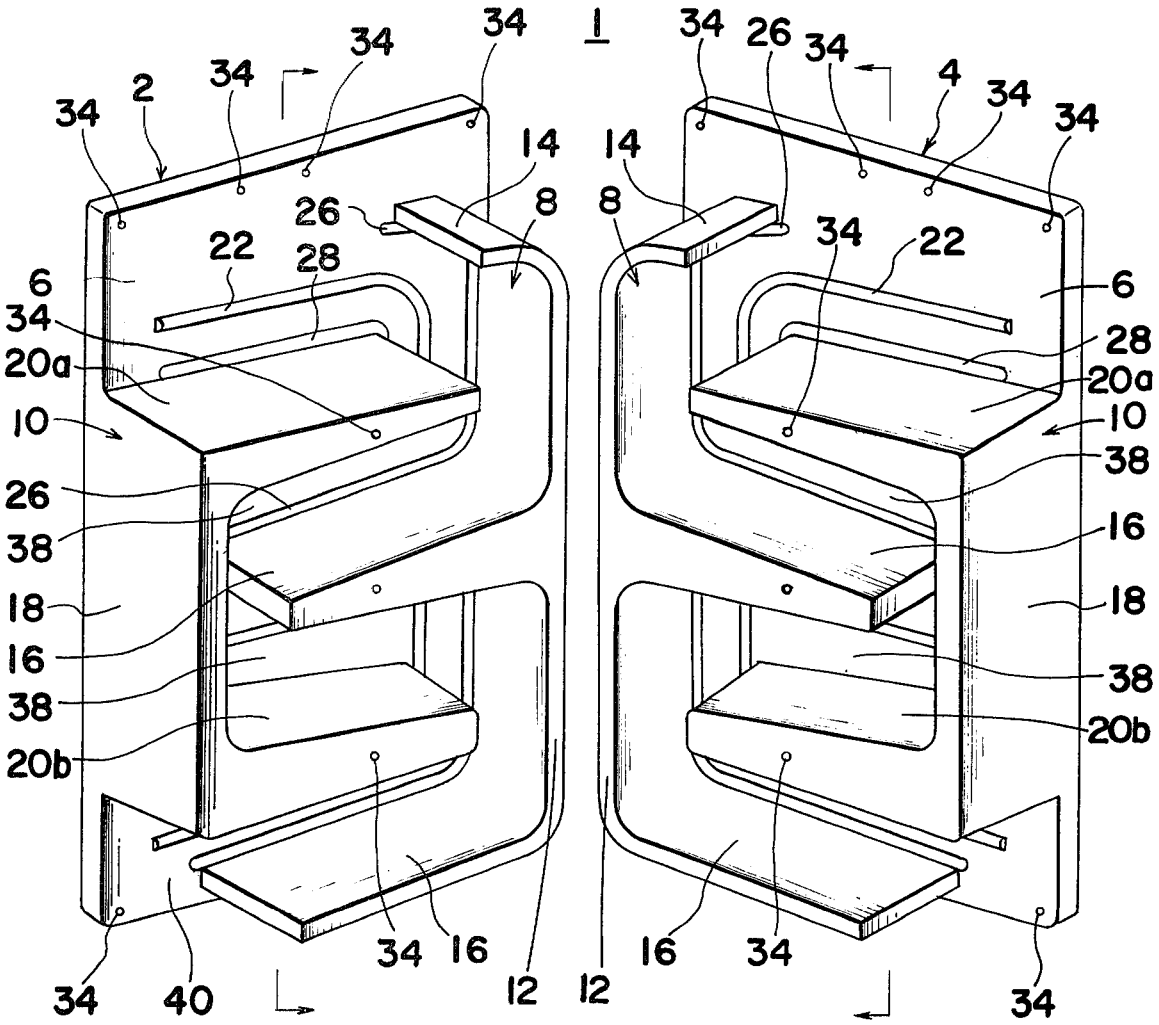
FIG. 1 is a exploded view showing a pair of rack halves of the first embodiment of a rack structure of the present invention.

Referring to FIG. 1, rack structure 1 comprises a pair of rack halves 2 and 4 formed symmetrically by use of any known plastic molding technique, each having a generally rectangular flat side wall 6 and rear and front ramp assemblies 8 and 10 projecting from and in a direction generally perpendicular to the side wall 6. The rear ramp assembly 8 of a shape generally similar to an inverted figure of "F" comprises a rear wall member 12 extending along and adjacent one side edge portion of the side wall 6 and having a curved end 14 at its top, and a rear ramp member 16 at its bottom, said rear ramp member 16 extending laterally from the rear wall member 12 and along and adjacent the bottom of the side wall 6 toward the front ramp assembly 10.

Figure 2:
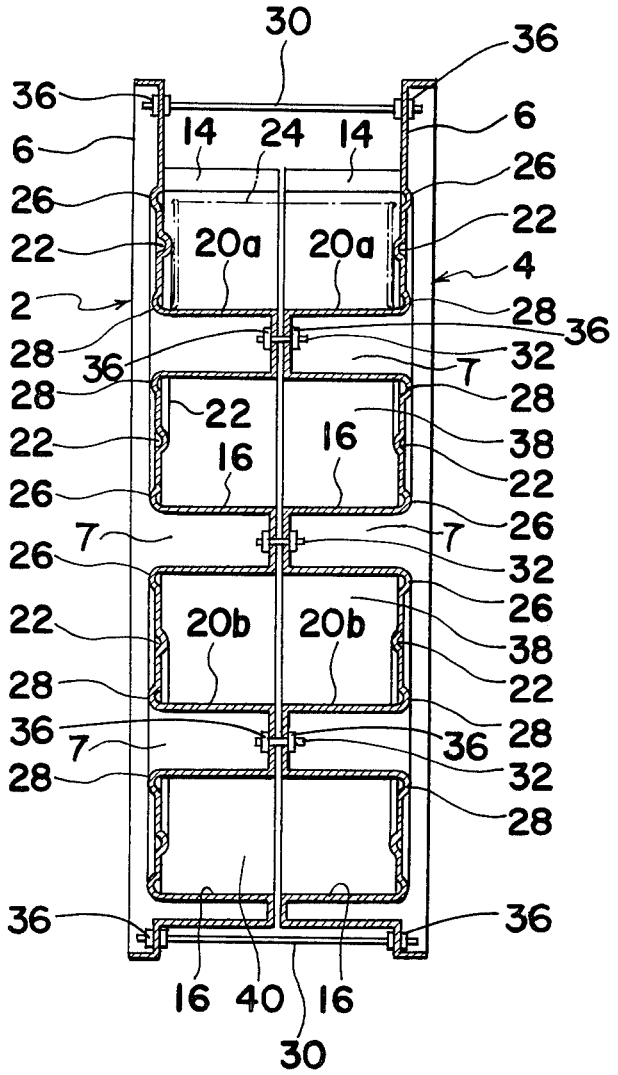
FIG. 2 is a cross-sectional view showing a rack structure in which the rack halves shown in FIG. 1 are connected together.

The front ramp assembly 10 of a generally U shaped configuration comprises a front wall member 18 extending along and adjacent the other side edge portion of the side wall 6 and having its opposed ends integrally formed respectively with upper and lower ramp members 20*a* and 20*b* extending laterally toward the rear ramp assembly 8 from the front wall member 18. The rear and front assemblies 8 and 10 are so positioned and so interleaved relative to the corresponding side wall 6 that the rear ramp member 16 of the rear ramp assembly 8 protrudes into a space between the upper and lower ramp members 20*a* and 20*b* while the curved end 14 and the rear ramp member 16 respectively are positioned externally of the upper and lower members 20*a* and 20*b*. Thus, when the two rack halves 2 and 4 are connected together as shown in FIG. 2, the ramp assemblies 8 and 10 provide a substantially serpentine passage 38 defined between the ramp assemblies 8 and 10.

Each of the rack halves 2 and 4 further comprises substantially zig-zag shaped rib 22 for guiding a corresponding end of a can 24 being moved through the serpentine passage and a pair of substantially zig-zag shaped grooves 26 and 28. While the groove 26 extends following the contour of the rack assembly 8 and the groove 28 following the contour of the rack assembly 10, the rib 22 outwardly projecting from the flat side wall 6 extends substantially intermediately or intermediately between these grooves 26 and 28.

The rack halves 2 and 4 are molded in the form of thin resin plates of equal thickness. There are hollow spaces 7 inside rack halves 2 and 4.

The two rack halves 2 and 4 constructed as mentioned above are connected together as shown in FIG. 2 by means of a plurality of screws 30 and 32 passing through respective holes 34 defined in the side wall 6 and the ramp assemblies 8 and 10 and fastened with nuts 36 so that the ramp assemblies 8 and 10 of the respective rack halves 2 and 4 are connected in face to face relation together to provide the complete rack structure 1 having the serpentine passage 38 for accomodating a plurality of cans 24 and for allowing the successive passage of the cans 24 therethrough.

The rack structure 1 is installed within a housing of a vending machine.

When the cans 24 are placed one after another onto the uppermost ramp members 20*a*, each can moves through the passage 38 towards the ramp members 16 by the effect of gravity and they are consecutively stacked one above the other in the serpentine passage 38.

When the rack structure 1 is installed in the vending machine, an opening 40 defined by the free ends of the lowermost ramp members 16 and the lowermost ends of the walls 18 communicates to a chute leading to the outside of the machine housing and accessible to a customer trying to buy one or more cans from the vending machine.

According to the embodiment of the rack structure as shown in FIGS. 1 and 2, the rack assemblies 8 and 10 when formed into a single unitary body facilitate to smooth running of the cans without being jammed which often occurs in the conventional rack structure.

In addition, since the serpentine passage 38 is provided with the grooves 26 and 28 on respective sides thereof, shoulders at the opposed ends of a can 24 are prevented from contacting the corner of the bottom of the ramp assemblies 8 and 10 and each can is allowed to move straightly downwardly within the serpentine passage 38.

Figure 3:
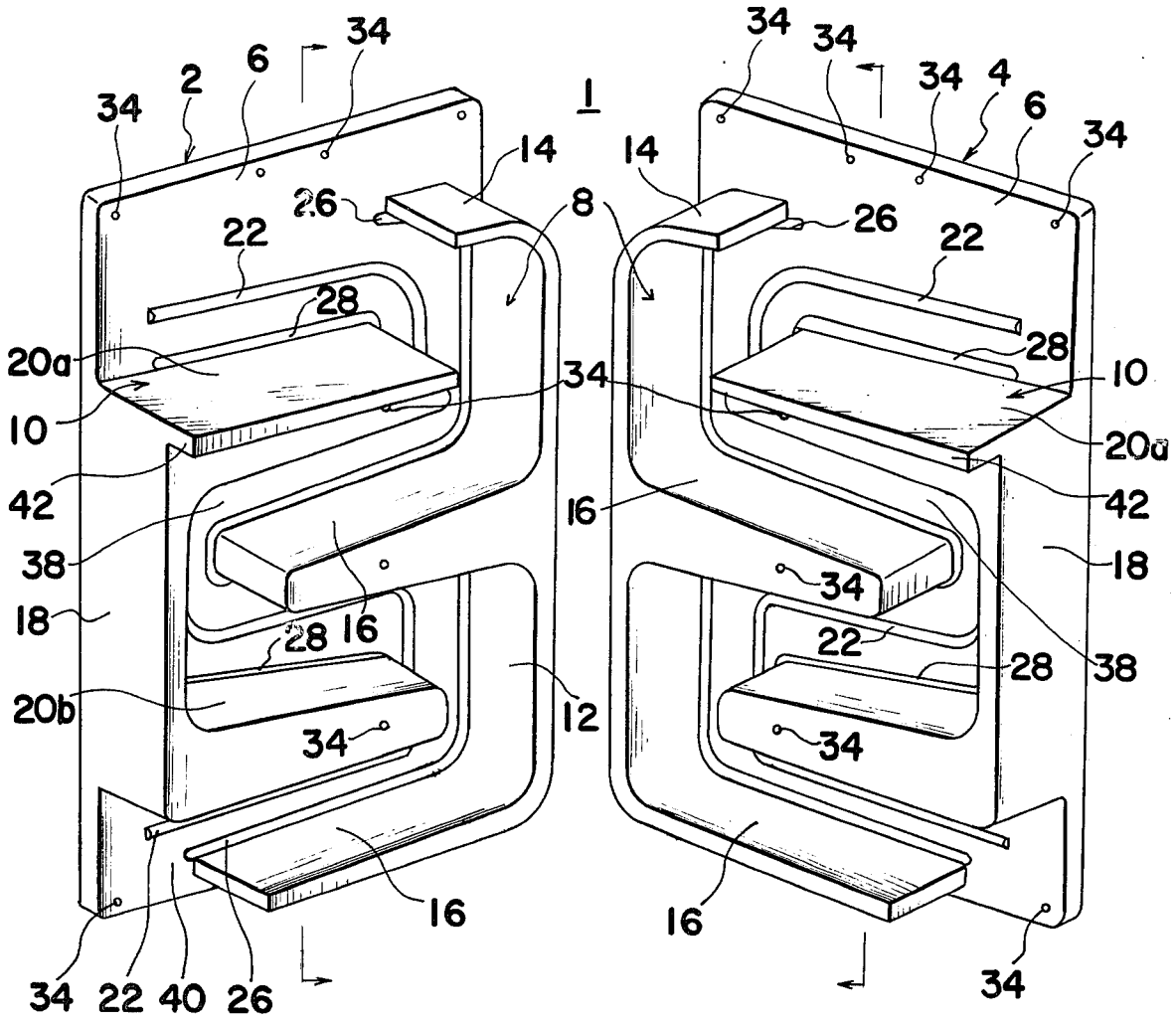
FIG. 3 is a exploded view showing a pair of rack halves of the second embodiment of a rack structure of the present invention.
Figure 4:
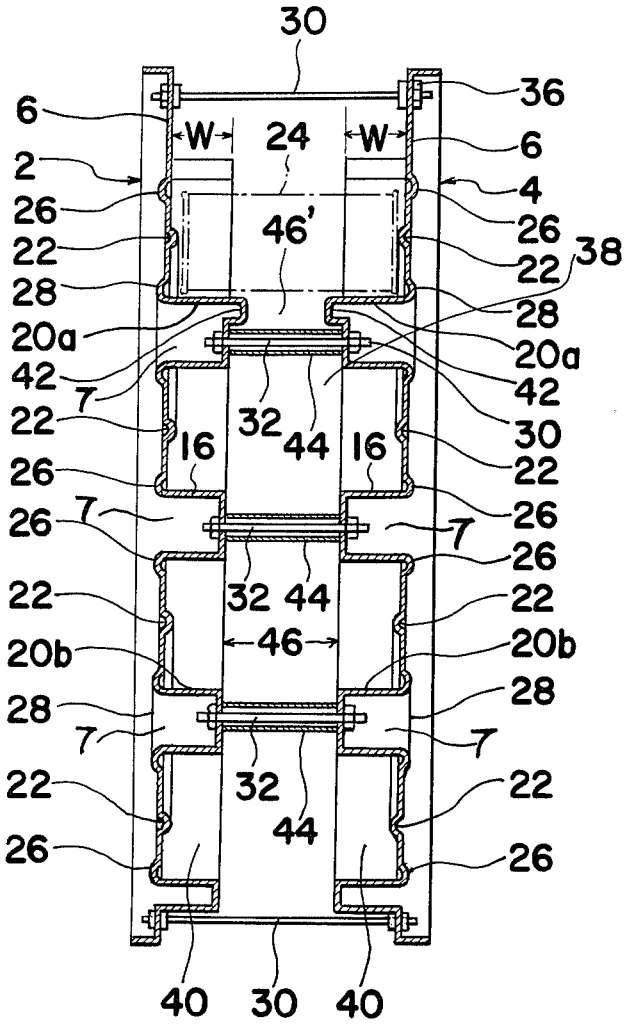
FIG. 4 is a cross-sectional view showing a rack structure in which the rack halves shown in FIG. 3 are connected together.

Referring to FIGS. 3 and 4 showing the second embodiment of the present invention, while each of the rack assemblies 8 and 10 projects in a direction perpendicular to the side wall 6 with a width W smaller than that of each of the rack assemblies in the embodiment of the FIG. 1, the uppermost front ramp members 20*a* have respective lateral flaps 42 projecting therefrom beyond the width W and extending over the entire length of the uppermost ramp members 20*a*.

The rack halves 2 and 4 mentioned above are connected together in a manner similar to that described in the embodiment of FIG. 1, with additional spacer sleeves 44 mounted on the screws 32, so that the two rack halves 2 and 4 are fixedly opposed to each other with a space 46 defined therebetween. It is to be noted that, in the assembled condition of the rack structure, the space 46 is narrowed by the flaps 42 to such an extent that even if a can 24 is erroneously placed with its ends oriented in a direction parallel to the elongated space between the ramp members 20*a*, it will not fall downwardly through such space.

When the cans 24 are placed on the uppermost ramp members 20*a* of the rack structure 1 of the second embodiment, the cans 24 can move into the serpentine passage 38 with their end portions resting on the ramp members 20*a*, since the flaps 42 serve to prevent the cans 24 from falling into the space 46'. Once the cans 24 are placed correctly in the serpentine passage 38, they can advance without being jammed despite that they are supported only at the opposed ends thereof by the ramp members.

An advantage of the second embodiment resides in that the amount of plastic material for molding the rack halves can be reduced since the rack assemblies 8 and 10 can be formed smaller in width than the rack halves of the first embodiment.

Figure 5:
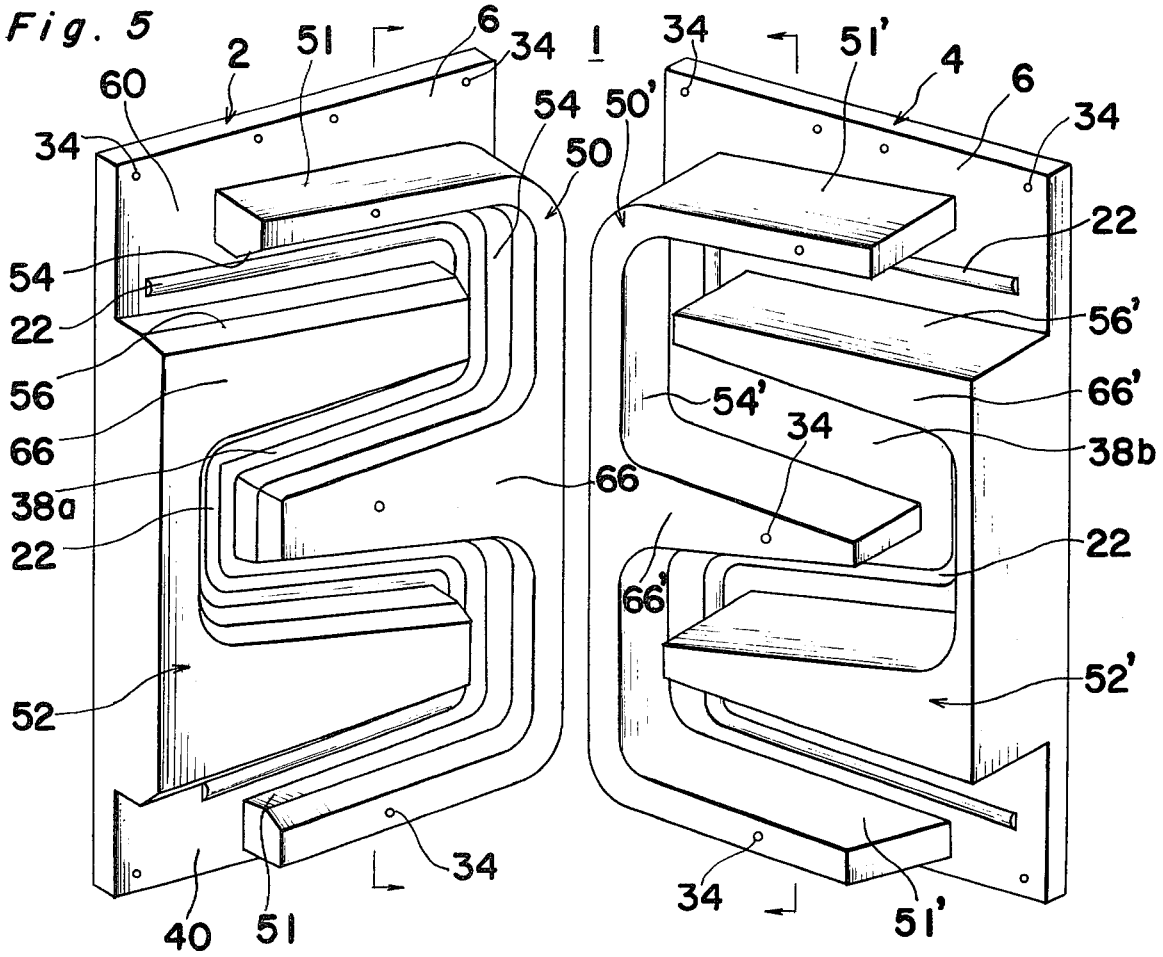
FIG. 5 is a exploded view showing a pair of rack halves of the third embodiment of a rack structure of the present invention.
Figure 6:
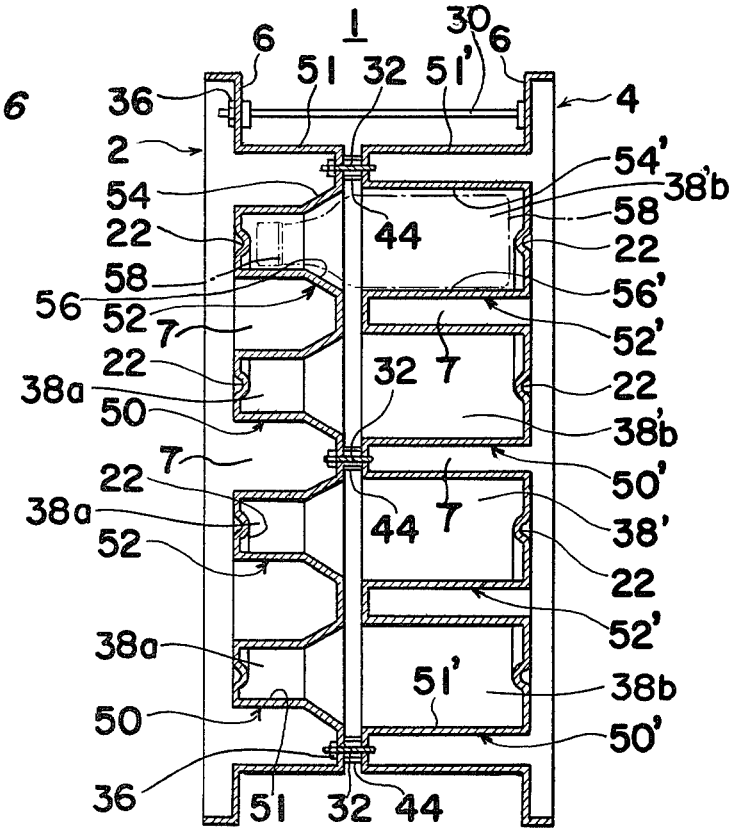
FIG. 6 is a cross-sectional view showing a rack structure in which the rack halves shown in FIG. 5 are connected together.

Referring to FIGS. 5 and 6 showing the third embodiment of the present invention for accommodating the bottles, while the ramp assemblies 50 and 50' of the rack halves 2 and 4 are made of a shape generally similar to a figure of "E", while the front ramp assemblies 52 and 52' are made of a shape generally similar to a figure of "U". The ramp assemblies are formed on the side walls 6 generally in a manner similar to that described in the foregoing embodiments except for the shape of the side faces 54 and 56 of the ramp assemblies 50 and 52 of the left-hand rack half 2.

The side faces 54 and 56 are formed to provide a left half portion of the serpentine passage 38*a* having a shape in cross-section generally analogous to the shape of the mouth portion of a bottle 58 accommodated therein.

On the other hand, the side faces 54' and 56' of the ramp assemblies 50' and 52' of the right-hand rack half 4 are formed so as to provide a right half portion of the serpentine passage 38*b* having a shape in cross-section analogous to the bottom portion of the bottle 58.

Each of the rack halves 2 and 4 comprises substantially zig-zag rib 22 for guiding a corresponding end of the bottle 58 being moved through the serpentine passages.

The rib 22 projects from the side wall 6 extending intermediately between the rear and front ramp assemblies 50, 52, 50' and 52'.

The two rack halves 2 and 4 are connected together as shown in FIG. 6 by means of a plurality of screws 30 engaged with the side walls 6 and fastened with nuts 36 and the screws 32 engaged with the female screw defined on the rack assemblies with spacer sleeve 44 so that the ramp assemblies 50, 52, 50' and 52' of the respective rack halves 2 and 4 are connected together in face to face relation to provide a complete rack structure 1 having the serpentine passages for accommodating a plurality of bottles 58 and for allowing the successive passage of the bottles 58 therethrough.

When the rack structure 1 constituted as mentioned above is installed in the housing of the vending machine, an opening 60 defined by the free ends of the uppermost ramp members 51 and 51' and side walls 6 provides an entrance for the bottles, while an opening 40 defined by the free ends of the lowermost ramp members 51 and 51' communicates the chute (not shown).

When the bottles 58 are supplied to the serpentine passage 38 through the entrance 60, they are placed on the ramp members 56, 56' in such manner that the mouth portion of the bottle 58 is fitted in the left half portion of the serpentine passage 38*a* defined by the ramp assemblies 50 and 52 of the left-hand rack half 2 with the mouth portion of the bottle 58 faced or contacted the rib 22, while the bottom end of the bottle 58 is fitted into the right half portion of the serpentine passage 38*b* defined by the ramp assembleis 50' and 52' of the right-hand rack half 4 with the bottom end of the bottle 58 faced or contacted the rib 22. Therefore, the bottle 58 can gravitate along the ramp assemblies with its attitude held in a direction perpendicular to the side walls 6 without being jammed.

Figure 7:
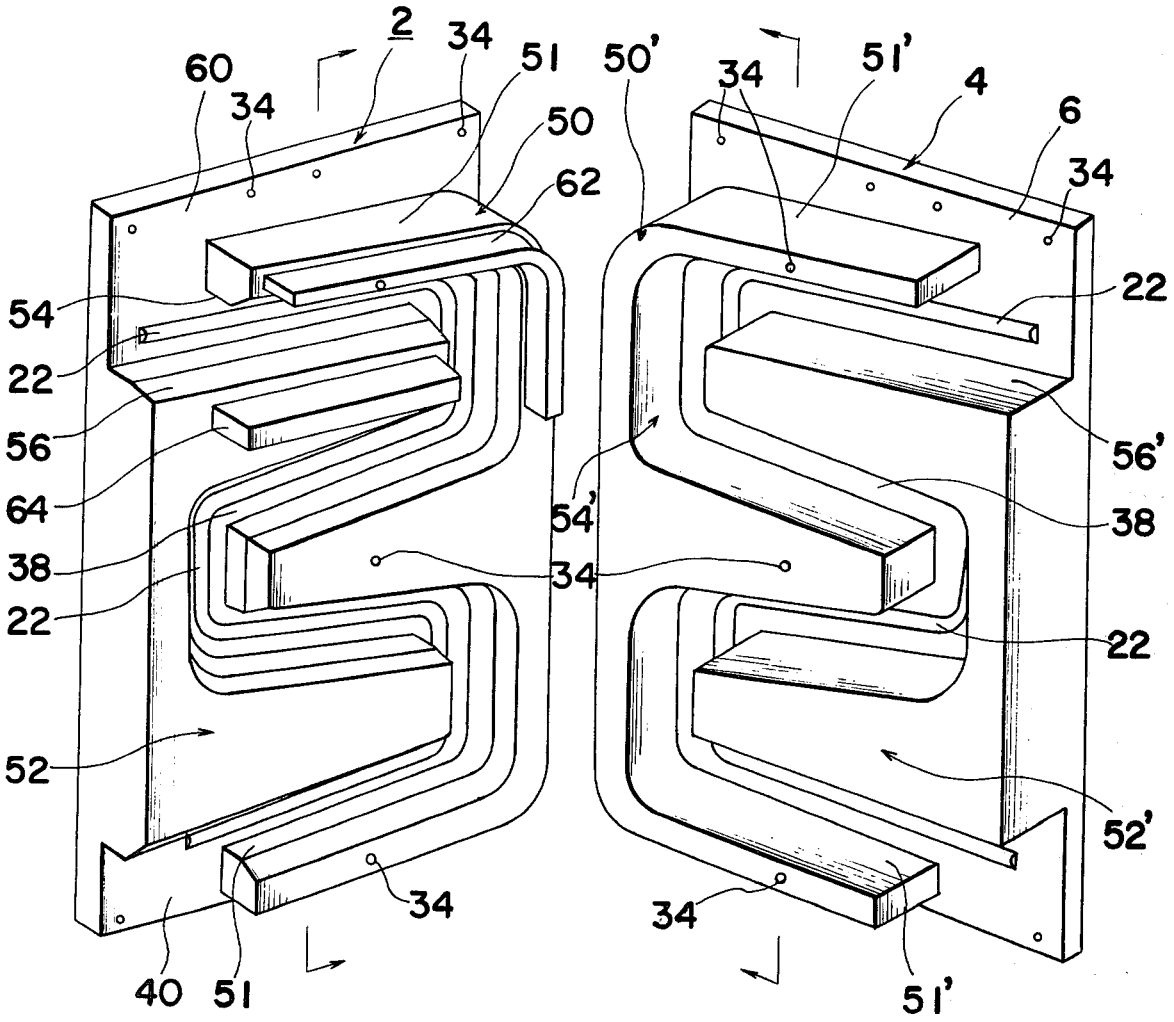
FIG. 7 is a exploded view showing a pair of rack halves of the fourth embodiment of a rack structure of the present invention.

Referring to FIG. 7 showing the fourth embodiment of the present invention, while width of each of the ramp assemblies 50, 52, 50' and 52' is reduced to such an extent that only bottom portion of the bottles 58 are placed thereon. But two lateral flaps 62 and 64 projecting from the ramp assemblies 50 and 52 of the left-hand rack half 2 extend along each top portion of the ramp assemblies 50 and 52 so as to facilitate to introduce the bottles into the serpentine passage 38.

The two rack halves 2 and 4 are connected together in a manner similar to that of foregoing embodiment with a space between the rack halves 2 and 4 larger than that of embodiment shown in FIGS. 5 and 6 for the bottles 58 having same length.

Figure 8:
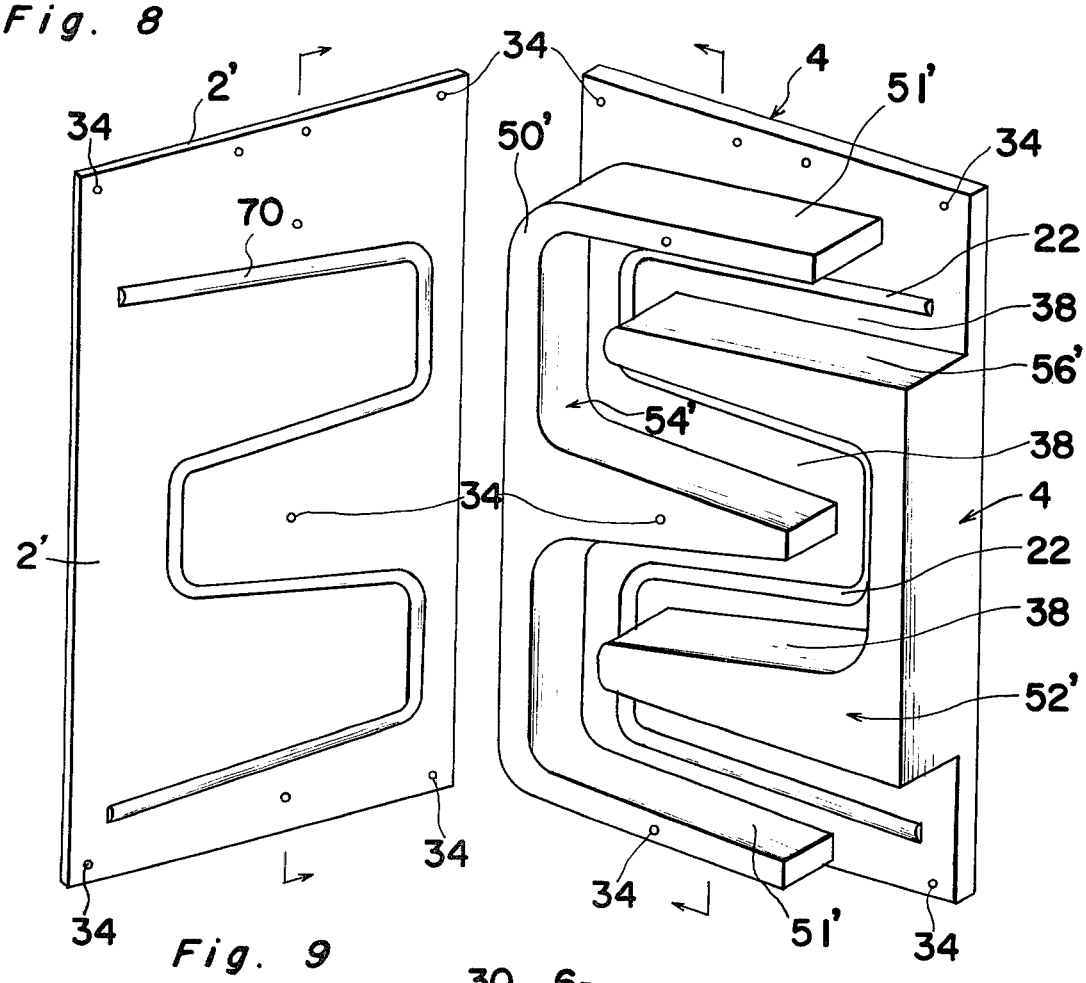
FIG. 8 is a exploded view showing a pair of rack halves of the fifth embodiment of a rack structure of the present invention.
Figure 9:
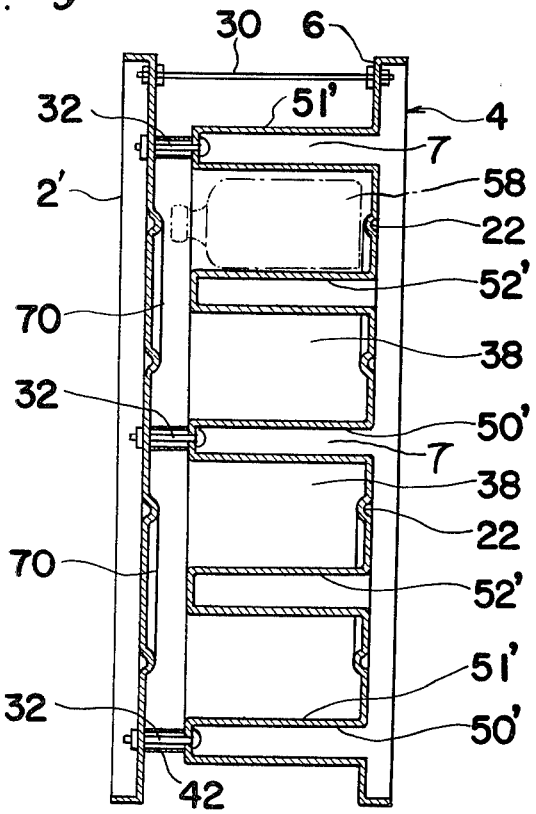
FIG. 9 is a cross-sectional view of the rack structure in which the rack halves shown in FIG. 8 is connected together.

Referring to FIGS. 8 and 9 showing the fifth embodiment of the present invention while one of the rack halves are formed in the form of flat plate member 2' having a zig-zag shaped rib 70 formed along the line corresponding to the serpentine passage 38 defined by the ramp assemblies 50' and 52' of the rack half 4 so as to guide the top of the bottles 58, wherein each body of the bottles is accommodated in the serpentine passage 38 as shown in FIG. 9.

Figure 10:
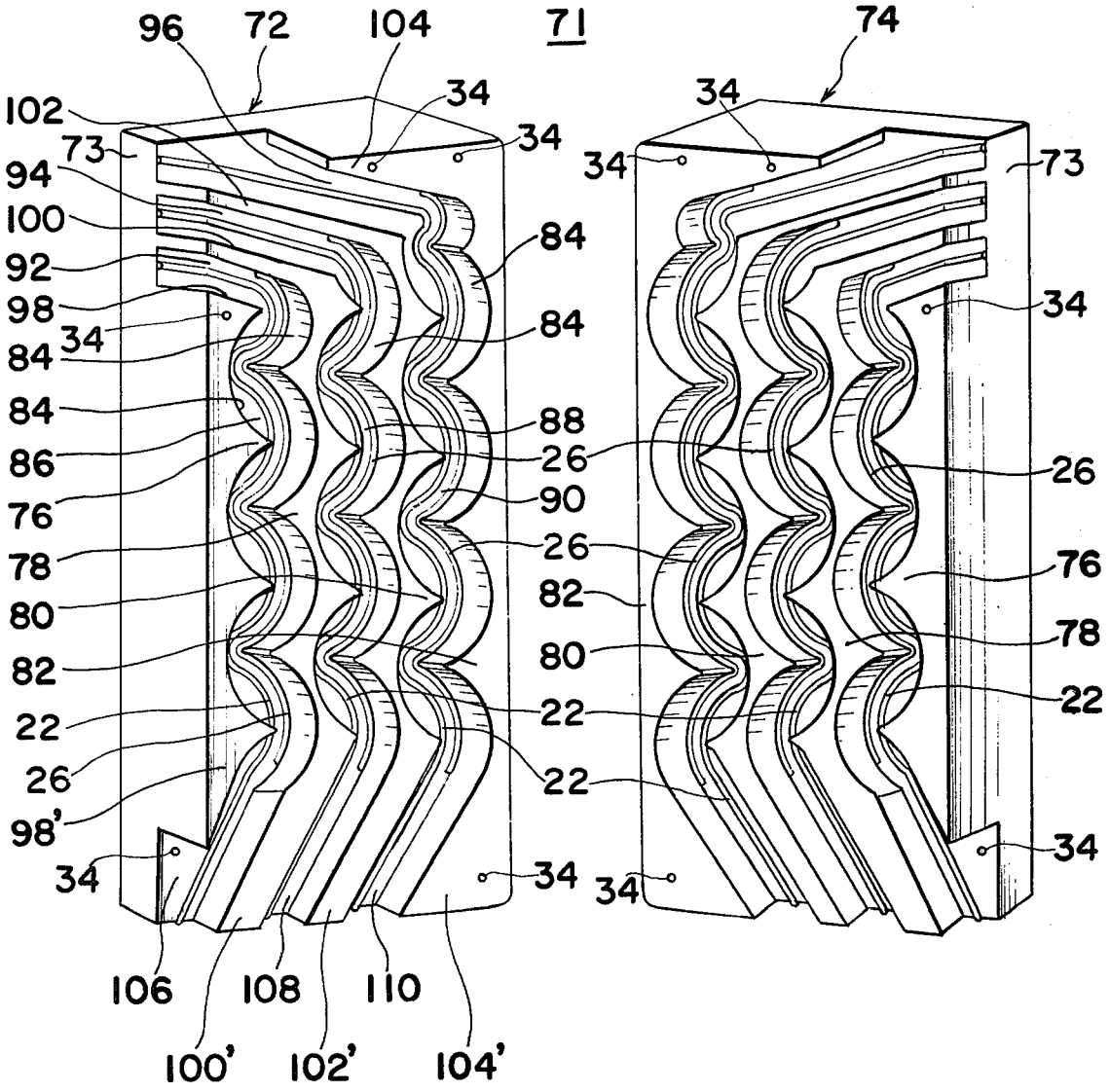
FIG. 10 is a exploded view showing a pair of rack halves of the sixth embodiment of a rack structure of the present invention.

FIG. 10 shows the sixth embodiment of the present invention. In this embodiment, the rack structure 71 comprises a pair of rack halves 72 and 74 formed symmetrically by the use of any known plastic molding technique. Each of the rack halves 72 and 74 comprising four rows of ramp assemblies 76, 78, 80 and 82 having consecutive U-shaped inside walls which, when the halves 72 and 74 are connected together, serve as ramp members 84.

Each recess of the U-shaped inside wall of one row of the ramp assembly is adapted to face a corresponding ridge of the U-shaped inside wall of the next adjacent row of the ramp assembly so that a plurality of serpentine passages 86, 88 and 90 are defined by the ramp assemblies 76, 78, 80 and 82.

Ribs 22 are projected outwardly intermediately in the respective serpentine passages 86, 88 and 90, while the grooves 26 and 28 (28 is not shown) in the form of elongated recess are also provided along the contours of each of the ramp assemblies 76, 78, 80 and 82 in a manner similar to the grooves shown in the foregoing embodiments.

In the uppermost portion of each of the rack halves 72 and 74, there are provided three entrance passages 92, 94 and 96 defined by ramp members 98, 100, 102 and 104 extending downwardly in a direction away from the front wall 73 in parallel relation to each other.

The entrance passages 92, 94 and 96 are communicated to the serpentine passages 86, 88 and 90 respectively.

In the lowermost portions of the rack halves 72 and 74, there are provided three outlets 106, 108 and 110 defined by the lowermost free ends of the ramp assemblies 98', 100', 102' and 104'.

The outlets 106, 108 and 110 are communicated to the serpentine passages 86, 88 and 90 respectively at upper ends and also to a common chute (not shown) leading the outside of the vending machine at the bottom ends.

The rack halves 72 and 74 are molded in the form of thin plates of equal thickness and having hollow spaces inside rack halves 72 and 74, in a manner similer to those as shown in the foregoing embodiments.

The two rack halves 72 and 74 are connected together by means of screw and nuts in a similar manner as described in connection with the foregoing embodiment of FIGS. 1 and 2 and installed in a vending machine.

The rack structure of a construction shown in and described with reference to FIG. 10 is advantageous in that three type of canned products or articles containing different contents can be accommodated in the respective serpentine passages 86, 88 and 90. This means that the vending machine with this rack structure installed therein can be used for selling three different types of canned products simultaneously.

Figure 11:
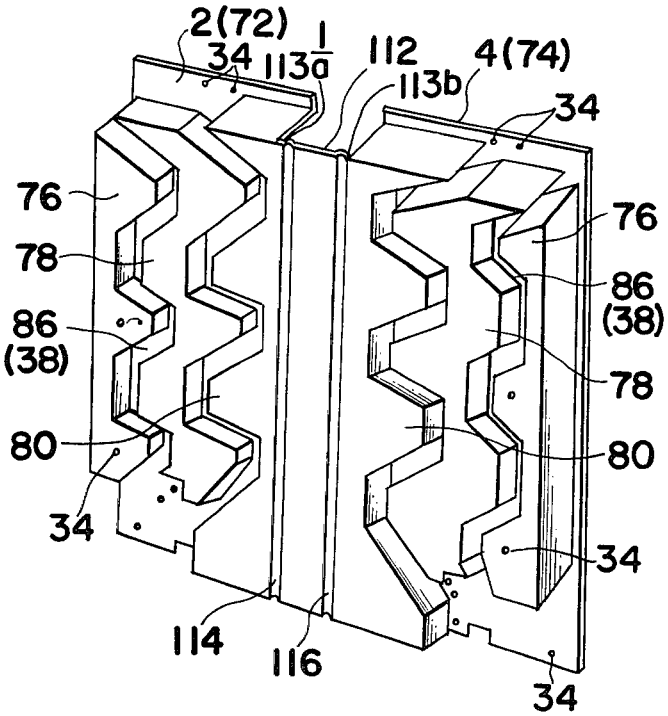
FIG. 11 is a perspective view of a pair of rack halves of the seventh embodiment of a rack structure of the present invention.

As shown in FIG. 11, the rack halves 2 and 4 (or 72 and 74) mentioned above are may be molded into a single unitary body with a connecting plate 112 which connects opposed sides of the rear edges 113*a* and 113*b* of each of the rack halves 2 and 4 (or 72 and 74) through two parallel foldable lines 114 and 116 formed in the form of elongated recess.

Figure 12:
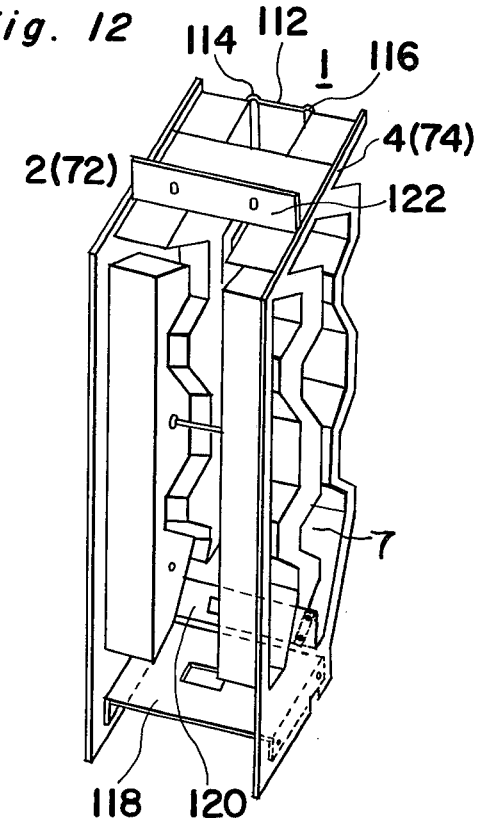
FIG. 12 is a perspective view of a rack structure using tha rack halves shown in FIG. 11.
Figure 13:
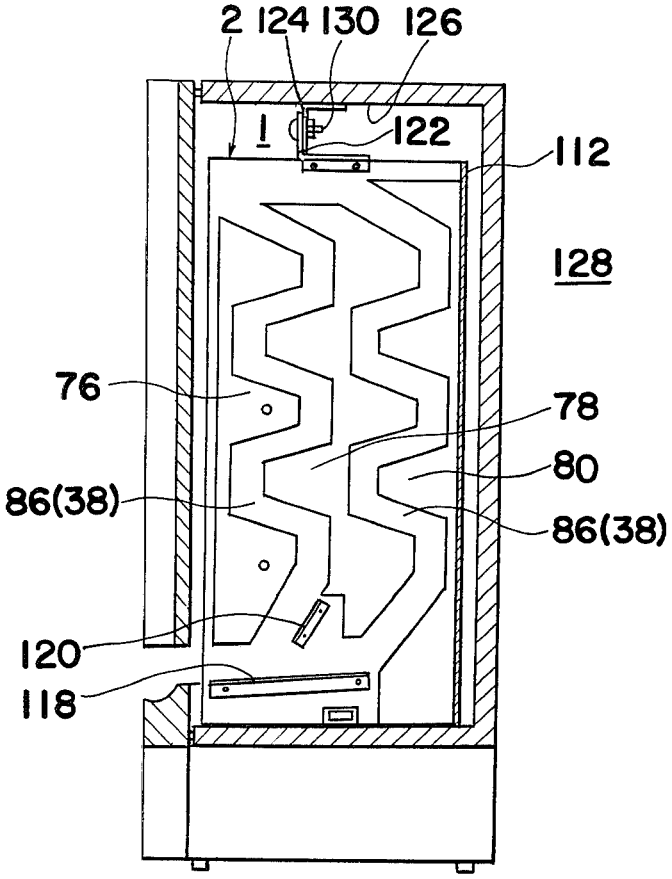
FIG. 13 is a cross-sectional view showing a way of an example of installing of the rack structure of the present invention into a vending machine.

When installed in the housing of the vending machine, the rack structure 1 shown in FIG. 11 is folded along the foldable lines 114 and 116 so that the two rack halves 2 and 4 (or 72 and 74) oppose parallelly as shown in FIG. 12. The two rack halves 2 and 4 (or 72 and 74) are fastened by means of U-shaped bottom plates 118 and 120 and top plate 122 crossed between the top edge portions of the two rack halves and each being fastened by screws (not shown).

Each of the bottom plates 118 and 120 works as guide members for guiding the cans discharged from the serpentine passages 86 or 38 to the chute.

While the top plate 122 is fastened with a securing plate 124 fixed under the ceiling 126 of the housing of the vending machine 128 by means of screw 130 so that the rack assembly 1 is fixed to the housing.

In order to maintain the cans or bottles in the or each serpentine passage and to release them one by one according to customer's instructions, a known gate device is provided in the vicinity of the outlet of the serpentine passage.

According to the present invention, as the rack halves are formed in the form of a unitary body with light weight, the rack halves can be readily installed in the housing of a vending machine, thereby resulting in reduction of time for installing the rack structure in the housing of a vending machine. Therefore, according to the present invention, cost of a vending machine can be effectively reduced.

In addition, each serpentine passage is formed by the ramp assemblies having seamless smoothed surface, so that the cans or bottles can be advance the serpentine passage without being jammed.

Although in the foregoing embodiments, the rack halves are formed of synthetic resin, according to the present invention rack halves may be formed of other material such as metal, by using a casting technique or the like. While a number of the ramp members provided in one ramp assembly may be increased at need.

What is claimed is:

1. In a rack structure for a vending machine which comprises a pair of plastic rack halves each formed in a single unitary body, said rack halves when combined together in face-to-face relation having at least one serpentine passage defined therein, said serpentine passage having a first end, through which a plurality of articles are supplied successively into the serpentine passage, and a second end from which the articles in the serpentine passage can be removed one at a time from the rack structure, and means for connecting the rack halves together, said first end of the serpentine passage being positioned above said second end of the serpentine passage whereby the articles accomodated within the serpentine passage can move downwardly from said first end towards said second end successively by gravitational force each time the articles are removed from the rack structure from said second end one after another, at least one of the said rack halves comprising a substantially rectangular wall; at least two rows of ramp assemblies spaced apart from each other and cooperative with each other to define the serpentine passage; said ramp assemblies projecting from and in a direction substantially perpendicular to the substantially rectangular wall, and having ramp members alternately protruding into respective spaces each defined between the adjacent two of the ramp members of the other ramp assembly such that the passage assumes a serpentine shape when the rack halves are combined together, said substantially rectangular wall having a rib protruding outwards therefrom at a position intermediately between each one ramp member of said one ramp assembly and the next adjacent ramp member of said other ramp assembly and extending along the contour of the serpentine passage and grooves formed near the base portions of each of the ramp members along the contour of the serpentine passage.

2. The rack structure according to claim 1, wherein said ramp assemblies include a wall member extending in a direction generally longitudinally of the substantially rectangular wall.

3. A rack structure as claimed in claim 2, wherein the width of the ramp member of any one of the ramp assemblies of the respective rack halves, which is adjacent said one end of the serpentine passage is larger than that of the remaining ramp members of any one of the ramp assemblies of the respective rack halves.

4. The rack structure according to claim 1, wherein each of ramp members of the ramp assemblies is formed by an arcuate wall member.

5. A rack structure as claimed in claim 1, wherein the other of the rack halves comprises a substantially rectangular wall, at least two rows of ramp assemblies spaced apart from each other and cooperative with each other to define the serpentine passage when said other of the rack halves are connected together with said at least one of the rack halves, each of said ramp assemblies including a wall member extending in a direction generally longitudinally of the substantially rectangular wall, and a plurality of ramp members projecting from and in a direction substantially perpendicular to the substantially rectanglar wall, the ramp members of one ramp assembly alternately protruding into respective spaces each defined between the adjacent two of the ramp members of the other ramp assembly such that the passage assumes the serpentine shape when the rack halves are connected together, said ramp members of the ramp assemblies of said other of the rack halves being, when said rack halves are connected together, respectively aligned with the ramp members of the ramp assemblies of said at least one of the rack halves while the wall members of the ramp assemblies of said other of the rack halves are also respectively aligned with the wall members of the ramp assemblies of said at least one of the rack halves.

6. A rack structure as claimed in claim 5, wherein said rectangular wall of said other of the rack halves has substantially elongated grooves extending following the contour of the serpentine passage.

7. A rack structure as claimed in claim 1, wherein the other of said rack halves has at least two rows of ramp assemblies having a plurality of ramp members asymmetrical in cross-section relative to the ramp members formed in said one of the rack halves, said cross-section being taken along the plane perpendicular to the direction of progress of the articles accommodated in the serpentine passege.

8. A rack structure as claimed in claim 7, wherein said articles are bottles and wherein the ramp assemblies of said one of the rack halves is adapted to provide a part of the serpentine passage having a cross-sectional shape corresponding to the shape of a mouth portion of any of the bottles while the ramp assemblies of said other of the rack halves is adapted to provide the other part of the serpentine passage having a cross-sectional shape corresponding to the shape of the bottom portion of any of the bottles.

9. A rack structure according to claim 1 wherein said pair of rack halves is formed by use of plastic molding technique.

* * * * *